US008381444B1

(12) United States Patent
McDonald et al.

(10) Patent No.: US 8,381,444 B1
(45) Date of Patent: Feb. 26, 2013

(54) SLIDING DOOR ASSEMBLY

(75) Inventors: Timothy J. McDonald, Niceville, FL (US); Jerry Osborne, Fort Walton Beach, FL (US); Jerald Bunyan, Fort Walton Beach, FL (US); Giorgio Giuriato, Mary Esther, FL (US)

(73) Assignee: EAS Doors and Windows, Inc., Fort Walton Beach, FL (US)

( * ) Notice: Subject to any disclaimer, the term of this patent is extended or adjusted under 35 U.S.C. 154(b) by 195 days.

(21) Appl. No.: 11/880,899

(22) Filed: Jul. 26, 2007

(51) Int. Cl.
*E05D 15/10* (2006.01)

(52) U.S. Cl. ..... 49/213; 49/221; 49/223; 49/409; 49/411

(58) Field of Classification Search ..... 49/209, 49/211, 213, 221, 223, 225, 408, 409, 410, 49/411, 226, 228, 231
See application file for complete search history.

(56) References Cited

U.S. PATENT DOCUMENTS 2,878,532 A * 3/1959 Clark ..... 49/139
3,538,642 A * 11/1970 Fredricksen ..... 49/213
3,660,936 A * 5/1972 Bryson ..... 49/209
3,805,450 A * 4/1974 Forcina ..... 49/231
4,646,471 A * 3/1987 Shaiu ..... 49/231
4,976,066 A * 12/1990 Plummer et al. ..... 49/225
5,887,387 A * 3/1999 Dallaire ..... 49/408
5,970,657 A * 10/1999 Glass ..... 49/231
5,996,285 A * 12/1999 Guillemet et al. ..... 49/213
6,170,207 B1 * 1/2001 Saindon ..... 52/204.2
6,497,072 B2 * 12/2002 Fries ..... 49/209
6,826,867 B1 12/2004 McDonald et al.
2002/0017060 A1 * 2/2002 Kern et al. ..... 49/231
2002/0053166 A1 * 5/2002 Fries ..... 49/213
2006/0225357 A1 * 10/2006 Bortoluzzi ..... 49/213

* cited by examiner

*Primary Examiner* — Jerry Redman
(74) *Attorney, Agent, or Firm* — Peter Loffler

(57) ABSTRACT

A sliding door assembly has a frame with a movable panel and a fixed panel. The movable panel has a pair of rollers that roll along a header located above the panels with the rollers attached to the movable panel via posts that pass through a channel on the header. The posts pass through a curved section of the channel whenever the movable panel is proximate its closed position and a straight section of channel when the movable panel is traveling laterally. The movable panel presses against a gasket located on the frame components surrounding the movable panel wherein one or more latches press the movable panel against the gasket whenever this panel is in the closed position. Valve is positioned within a weep hole on the threshold in order to prevent water from seeping into the building via the bottom of the door assembly.

14 Claims, 10 Drawing Sheets

SLIDING DOOR ASSEMBLY

BACKGROUND OF THE INVENTION

1. Field of the Invention

The present invention relates to a sliding door assembly wherein the sash of the door seals against the door frame.

2. Background of the Prior Art

The main function of a building's envelope is to prevent water penetration into the interior of a building where such water can cause substantial damage. One problem in any envelope design is the junction between two or more items made from dissimilar materials such as where doors and windows integrate with the main building facade. As each item is made from a different material, each such material thermally expands and contracts at a different rate placing stress on the boundary joint of the dissimilar items. Caulks having a high coefficient of expansion and other techniques are used to address this problem. The caulks resiliently expand and contract and help modulate the expansion and contraction of the materials onto which they are deposited upon.

Operable windows are another problem area in building moisture intrusion. By definition, when a window is open, access is provided into the interior of the building. Once the window is closed it must provide a moisture barrier for the building. Windows that swing out to open, similar to doors, press up against a peripheral flange on the window frame, which flange has a gasket thereon, which gasket helps seal the sash of the window against the frame, providing the moisture barrier. In the case of an in-swing door, wherein the bottom of the door does not press up against a sealing flange, appropriate rubber sweeps are placed along the bottom of the door in order to block moisture penetration therepast and the threshold is angled outwardly in order to channel any residual moisture back out.

Sliding windows present another problem in dealing with moisture penetration. As the window must slide up and down in a track, the window cannot press against a sealing flange like a swing window. As the window only presses up against one side of its sash, this is the only side where it is possible to have a press seal against the frame. The opposing side of the window frame, where the sash typically interacts with another sash, which other sash may be fixed or movable, a gasket is provided on one of the sashes in order to provide a barrier between this junction. While such a gasket is not as formidable as a press seal, this junction is constructed such that the upper sash is oriented outwardly relative to the lower sash so that any moisture that challenges this gasket must travel upwardly to get to this seal. While it is possible to have storms that have winds that drive rain upwardly, the vertical vector component of such winds are not very large, therefore, the rain acts on the gasket with only a relatively small force, which the gasket is designed to handle. Additionally, such storms are very infrequent so that the gasket is not subject to frequent substantial challenges.

The sides of the window wherein the sash rides in a track pose a different problem. As the sash must travel up and down along this track, an airtight seal between sash and frame along the track is not possible. However, the tolerances between the sash and the frame are very tight so that most if not all moisture is stopped at the junction of sash and frame. For any moisture that bypasses this junction, the frames typically have a flanging system that deflects the water and channels the water back to the outside.

The problems associated with moisture barrier protection for horizontal sliding sashes and more particularly sliding glass doors is much more challenging. The junction between two closed sashes on a sliding glass door is vertically oriented. Therefore, the gasket that seals the junction between the two sashes is subject to rain any time the wind blows from the appropriate direction during a storm and as the door is at ground level, the lower part of the junction is subject to a rain load almost every shower due to the rain hitting the ground proximate the sash and splashing against the seal. Additionally, the flanging systems used on the windows to deflect moisture that passes the sash-frame contact area cannot be effectively used on the lower part of the door. As people must be able to pass through the door, the lower threshold must be kept to a reasonably short height in order to adequately facilitate walking therethrough. This height restriction is set not only by the desired comfort level of users of the door, but also by the Americans with Disabilities Act which sets upper height restrictions on all new construction sliding doors. Therefore, vertically disposed flanging systems that are commonly found on hung windows, which systems tend to be relatively wide, cannot be effectively deployed on a sliding glass door that has threshold height restrictions and that also requires that the threshold be subject to the load forces associated with people walking thereon. Accordingly, moisture barrier systems found on sliding doors tend to be less reliable relative to other door and window moisture barrier systems.

The flanging systems found on current sliding doors tend to have multiple spaced apart flanges in order to accommodate the tracks upon which each sash of the door slides and to act as rain barriers. Such a multiple flange configuration, even though it is relatively low in height, is somewhat uncomfortable to walk across and is difficult to bypass in a wheelchair that must pass across the several flanges.

Additionally, sliding doors tend to be larger relative to most windows, therefore, they tend to become "loose" over time through repeated use. As such doors require tight interfitting parts in order to achieve a strong moisture barrier capability, such loosening tends to degrade the moisture barrier capabilities of the door.

My previous patent, U.S. Pat. No. 6,826,867, incorporated herein in its entirety by reference, provides a sliding door system that has moisture barrier capabilities that address the above stated problems found in the art. While the sliding door assembly disclosed in my previous patent works with a high degree of efficiency and reliability, I have made several improvements that further enhance the capabilities and effectiveness of the sliding door assembly, which improvements are the subject of the present patent.

SUMMARY OF THE INVENTION

The sliding door assembly of the present invention provides a door assembly provides a moisture barrier that has a high level of reliability while using a small lower threshold that is relatively comfortable for a user to traverse and that complies with the Americans with Disabilities Act. The present sliding door assembly maintains its high level of moisture barrier reliability even after the door becomes loose through normal wear and tear and the passage of time. The sliding door assembly continues to be of relatively simple design and construction using standard manufacturing techniques and is relatively easy to use and maintain.

The sliding door assembly of the present invention is comprised of a frame that has a header and a threshold joined by a first mullion with a first angled face and a second mullion with a second angled face. The header has at least one channel, each channel with a curved section and a straight section. A compression gasket is attached to the header, the threshold, the first mullion, and the second mullion. A sash, has a first jamb with a third angled face and a second jamb with a fourth angled face, the first jamb and the second jamb being joined by a top leg and a bottom leg. A post is pivotally attached to the top of the sash and protrudes through the channel and has a roller rotatably attached to its end. A keeper is located on the first mullion while a latch is attached to the first side jamb of the sash. The sash is slidable between an open position and a closed position such that when the sash is in the closed position, the latch is received within the keeper and presses the sash into pressing engagement with the gasket in order to create a seal between the sash and the frame. When the sash is in the closed position, the post is within the curved section of the channel. When the sash slides to the open position, the post travels from the curved section to the straight section. The first angled face faces the third angled face and the second angled face faces the fourth angled face whenever the sash is in the closed position. The header slopes downwardly in proceeding from the straight section of the channel to the curved section of the channel in order to gravitationally assist the sash in sliding toward the closed position. The threshold has an upwardly extending lip opposite the gasket in order to guide the sash between the closed position and the open position and prevent the bottom of the sash from popping out of the frame structure. The gasket is located within a channel that extends along a portion of the header, the threshold, the first mullion, and the second mullion. The threshold is laterally and downwardly sloped (from inner facing surface wall to outward facing surface wall) and has a weep hole at a lower end, the weep hole having a one-way valve therein. The one-way valve, which is a specially designed valve that may be similar to a medical valve, may but need not necessarily be spring-loaded.

BRIEF DESCRIPTION OF THE DRAWINGS

Similar reference numerals refer to similar parts throughout the several views of the drawings.

DESCRIPTION OF THE PREFERRED EMBODIMENT

Figure 1:
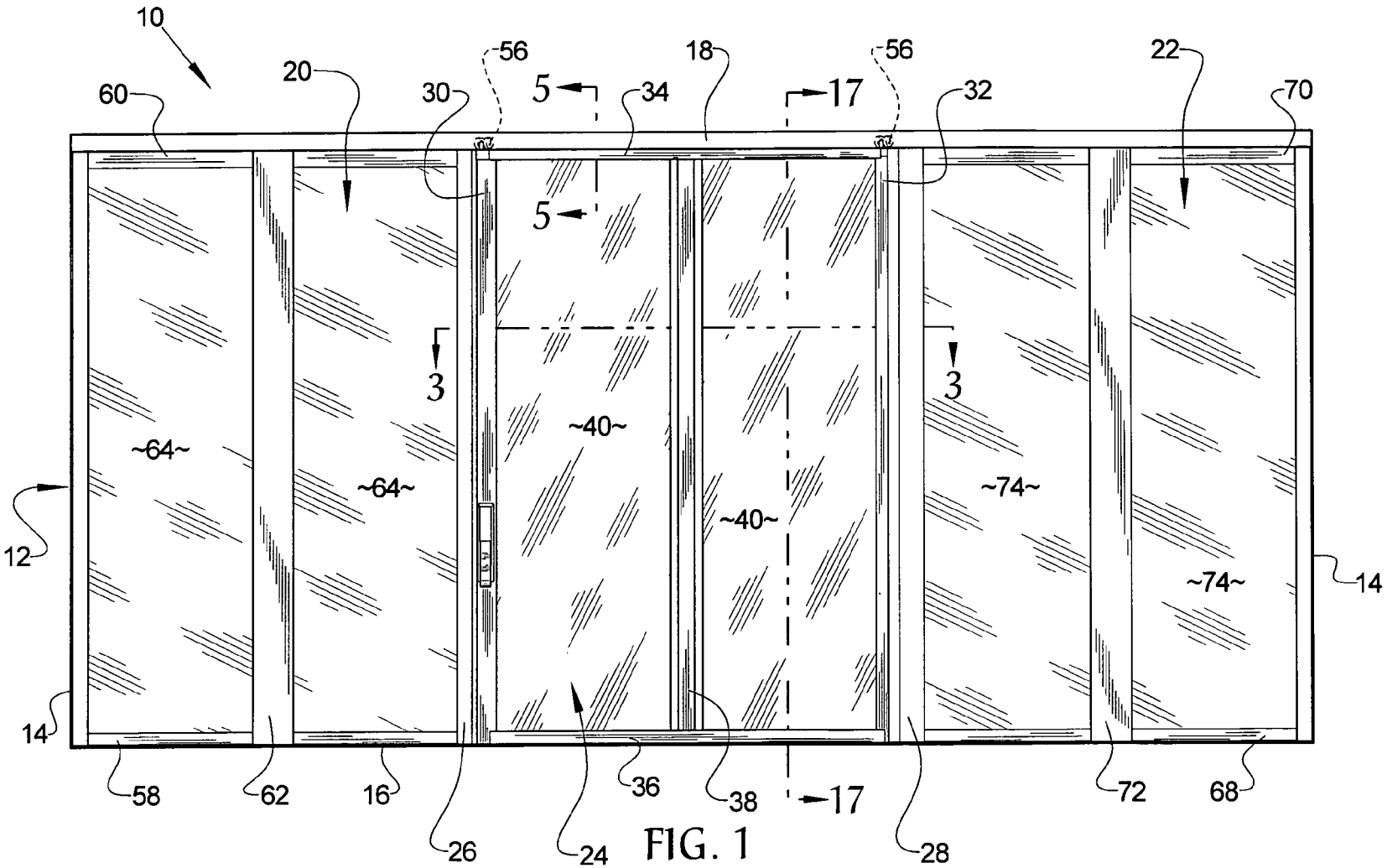
FIG. 1 is an elevation view of the sliding door assembly of the present invention.
Figure 2:
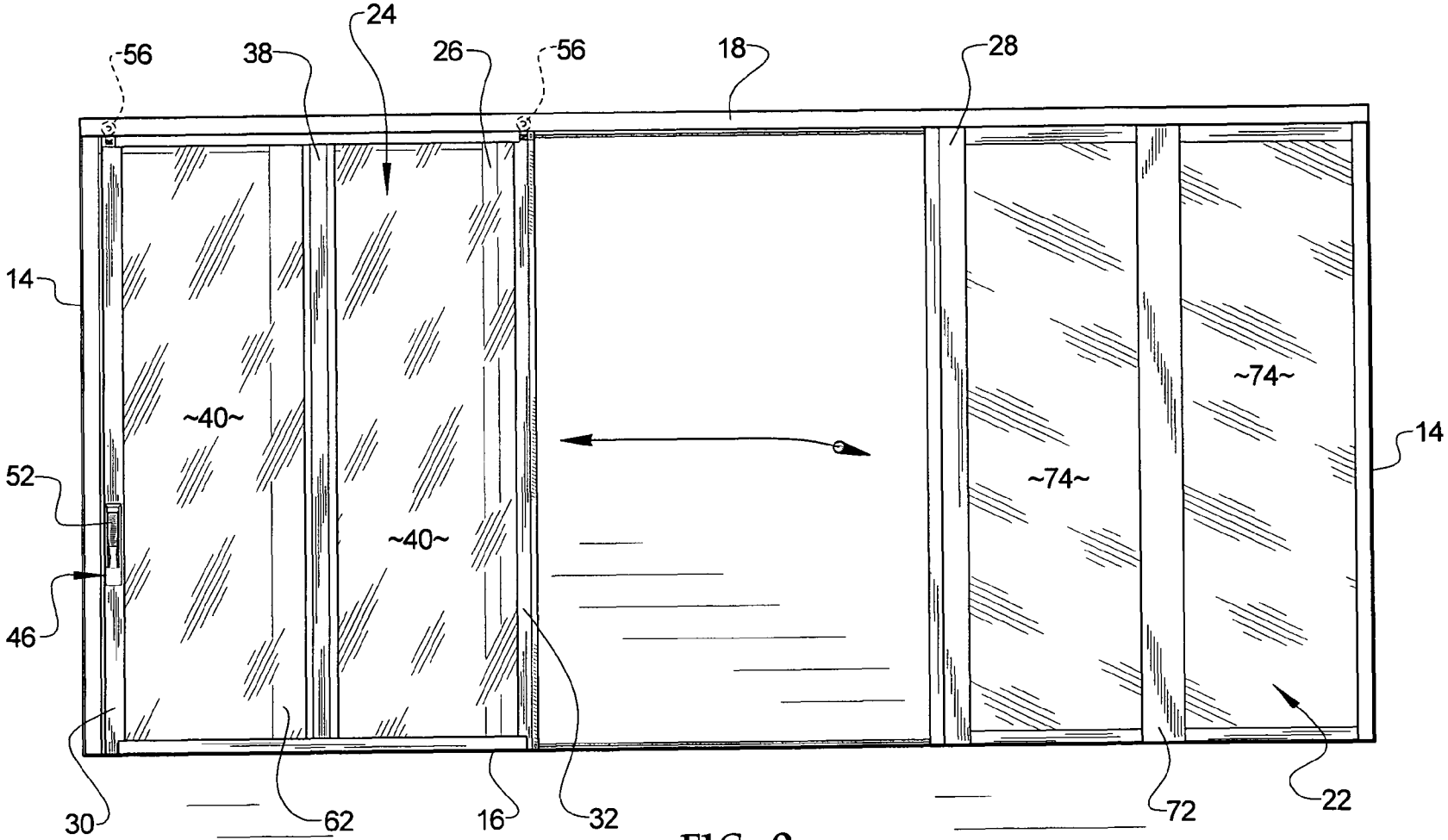
FIG. 2 is an elevation view of the sliding door assembly with the movable panel in an open position.
Figure 3:
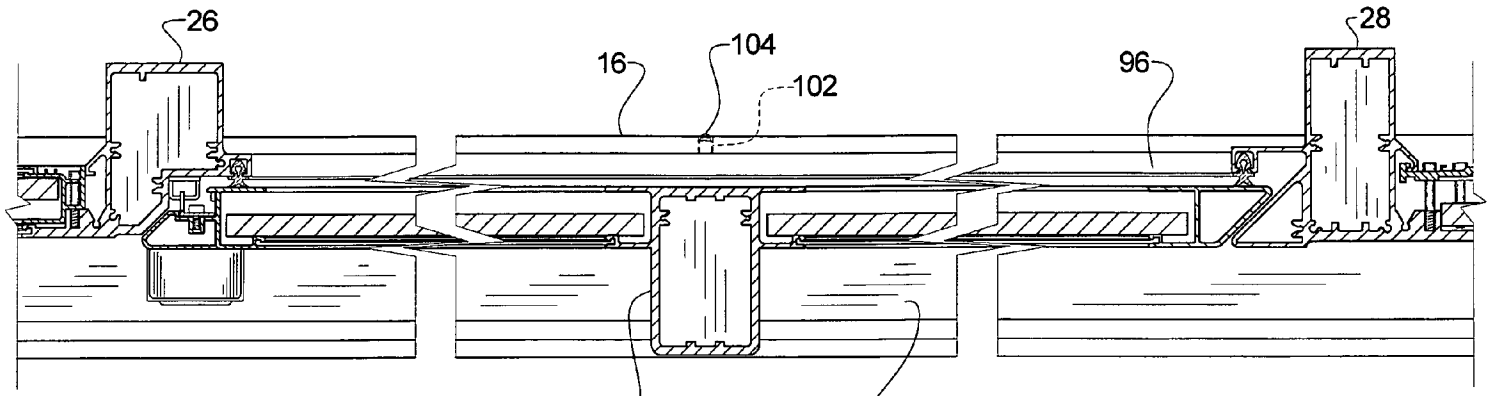
FIG. 3 is a section view, taken along line 3-3 in FIG. 1, showing the movable panel in a closed position.
Figure 4:
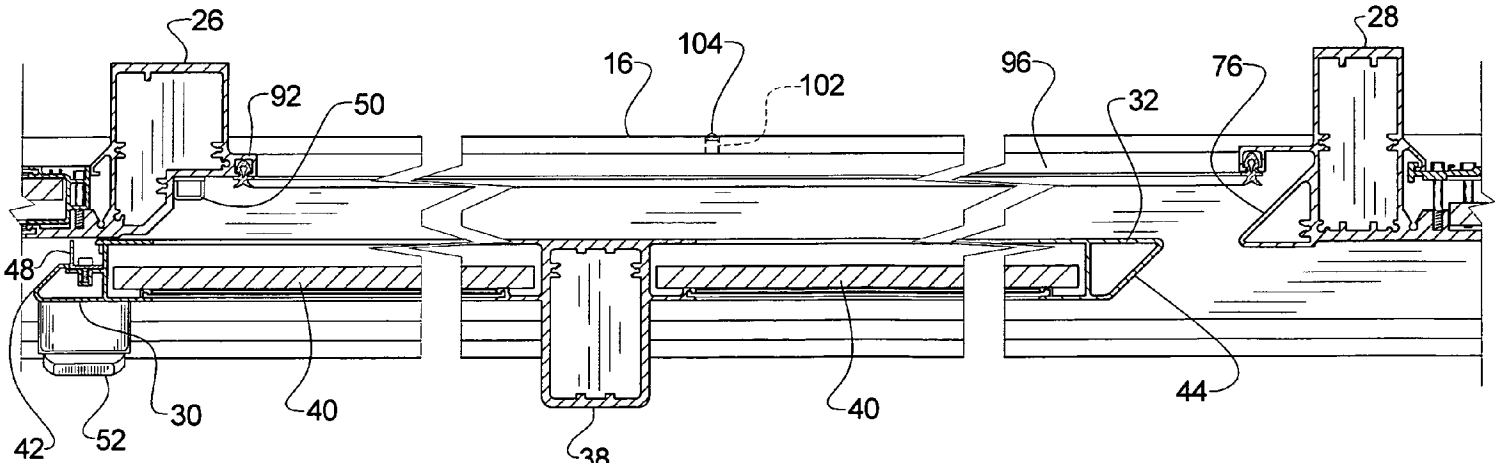
FIG. 4 is a section view showing the movable panel partially open.

Referring now to the drawings, it is seen that the sliding door assembly of the present invention, generally denoted by reference numeral 10, is comprised of an overall frame assembly 12 that has a pair of fixed jambs 14 on either side of the frame assembly 12, a sill or threshold 16 that connects the fixed jambs 14 at the lower ends thereof and a header assembly 18 that connects the fixed jambs 14 at the upper ends thereof. The sliding door assembly 10 is illustrated as a three panel system wherein an overlay panel assembly 20 and a non-overlay panel assembly 22 are each fixed and the middle panel assembly 24 is operable, however, the system 10 can be configured as a two panel 20 and 24 assembly, one panel assembly 20 fixed and the other panel assembly 24 operable or other appropriate sliding door configuration. A fix-move mullion 26 extends between the threshold 16 and the header assembly 18 proximate the overlay panel assembly 20 while a move-fix mullion 28 extends between the threshold 16 and the header assembly 18 proximate the non-overlay panel assembly 22.

As seen, the movable panel assembly 24 has a door latch side 30 and an opposing door side 32 joined with the door latch side 30 by a door top 34 and a door bottom 36. The movable panel assembly 24 may also have a mullion 38 and appropriate glazing units 40 fixed within the various framing members 30, 32, 34, 36, and 38 secured thereto in the appropriate way. The door latch side 30 has a first angled face 42 while the door side 32 has a second angled face 44. The door latch side 30 also has an appropriate latch assembly 46 thereon that is used to allow the movable panel 24 to be fixedly held to the fix-move mullion 26, such that one or more appropriate latches 48 are removably receivable within appropriate latch keepers 50 located on the fix-move mullion 26 such that when the latches 48 are received and engaged within their respective keepers 50, the movable panel assembly 24 is held in the closed position and when the latches 48 are not within their respective keepers 50, the movable panel assembly is free to move. Articulation of the latches 48 is controlled by the latch assembly 46 such that pulling up on the control bar 52 causes the latches 48 to be removed from their respective keepers 50 and throwing the latch bar 52 back down causes the latches 48 to be received back in their respective keepers 50 and engaged therein. The latch assembly 46 may also have an appropriate locking system of any appropriate design known in the art such that when the latches 48 are received within their respective keepers 50, the latches 48 may be locked via an appropriate lock control thereinto in order to lock the movable panel assembly 24. A pair of posts 54, extend upwardly from the door top 34, each post 54 being located proximate an end of the door top 34 and being rotatably attached thereto. At least one roller 56 is located on the head 57 on the distal end of each post 54.

The overlay panel assembly 20 comprises the above mentioned fixed jamb 14 and the opposing fix-move mullion 26 joined by a panel bottom 58 and a panel top 60. The overlay panel 20 assembly may have a mullion 62 and has appropriate glazing 64 fixed within the various framing members 14, 26, 58, 60, and 62 secured thereto in the appropriate way. As seen, the fix-move mullion 26 has a third angled face 66.

The non-overlay panel assembly 22 comprises the above mentioned fixed jamb 14 and the move-fix mullion 28 that are joined by a panel bottom 68 and a panel top 70. The non-overlay panel assembly 22 may have a mullion 72 and has appropriate glazing 74 fixed within the various framing members 14, 26, 68, 70, and 72 secured thereto in the appropriate way. If the non-overlay panel assembly 22 is not used, then the move-fix mullion 28 also serves as the outer jamb of the overall frame assembly 12 of the device 10. As seen, the move-fix mullion 28 has a fourth angled face 76.

Figure 5:
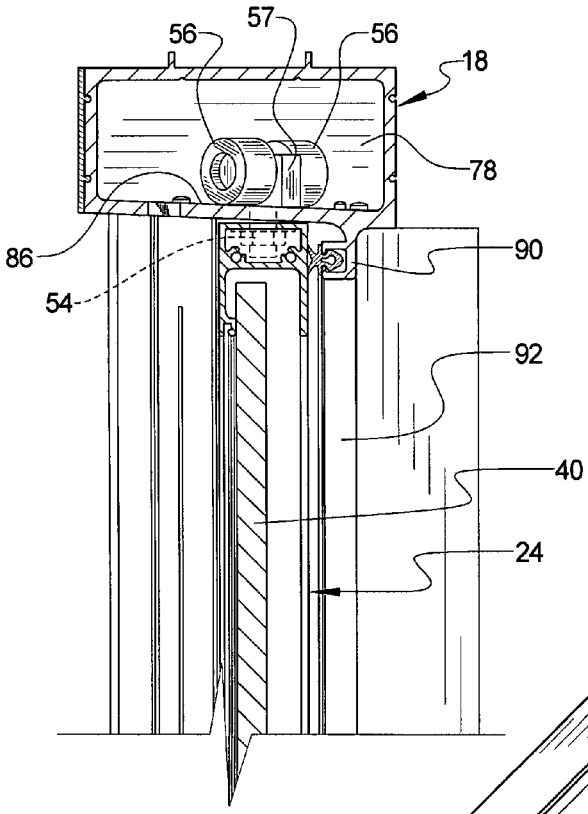
FIG. 5 is a section view, taken along line 5-5 in FIG. 1, illustrating the header details.
Figure 6:
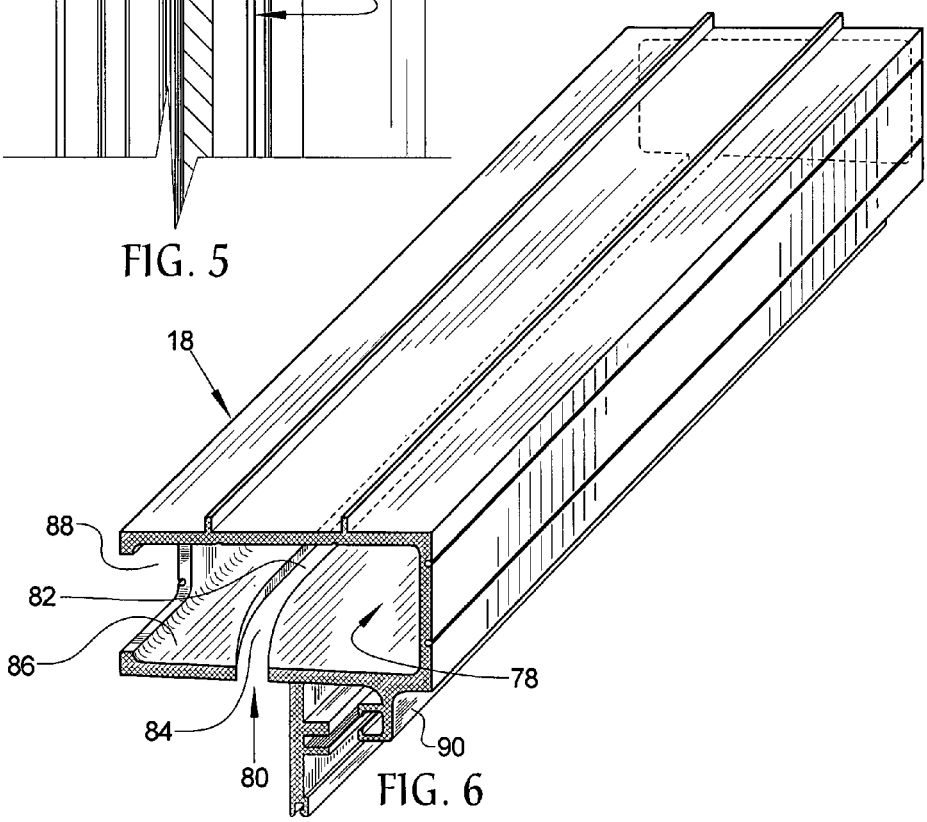
FIG. 6 is a perspective view of the header.
Figure 7:
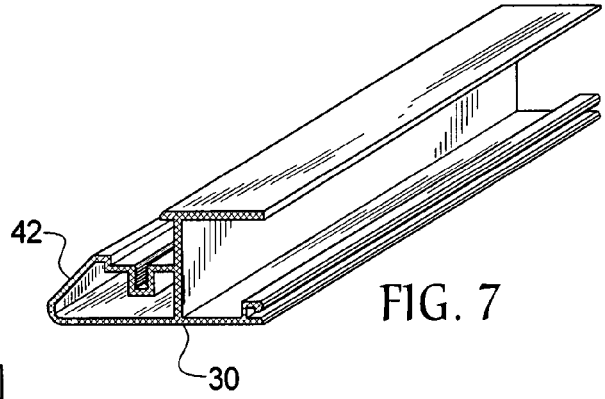
FIG. 7 is a perspective view of the door latch side extrusion.
Figure 8:
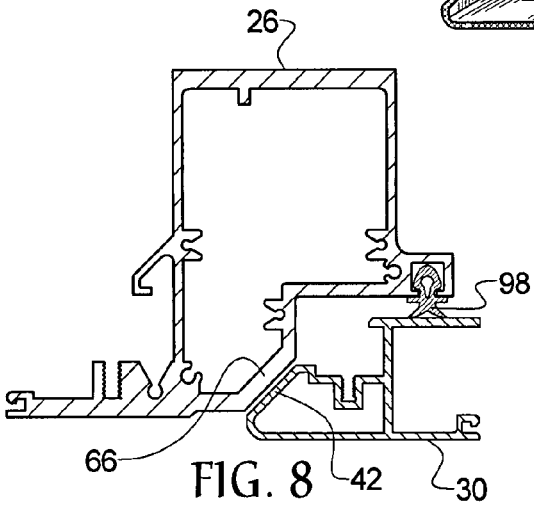
FIG. 8 is a section view taken along line 8-8 in FIG. 9.
Figure 9:
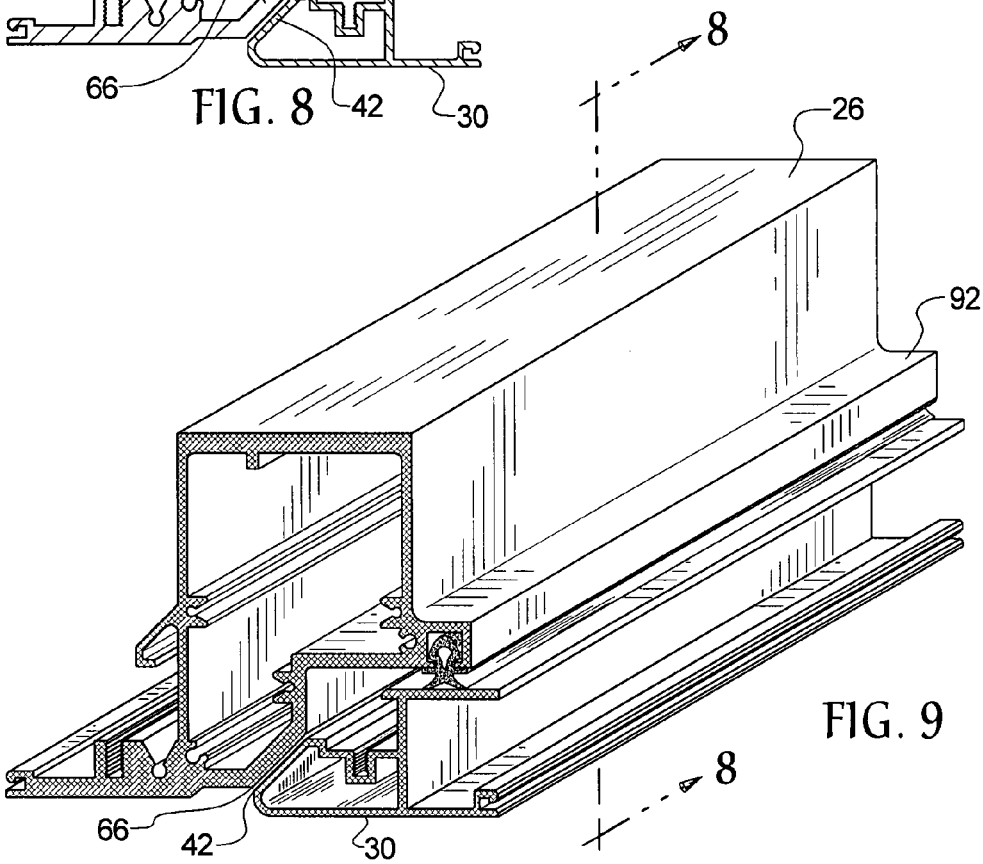
FIG. 9 is a perspective view of the fix-move mullion and the door latch side extrusion in a mated relationship when the movable panel is in the closed position.
Figure 10:
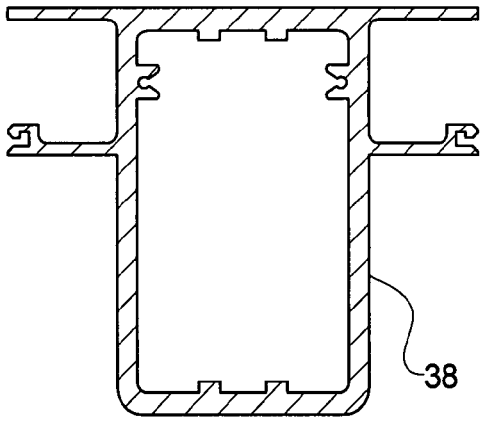
FIG. 10 is a section view taken along line 10-10 in FIG. 11.
Figure 11:
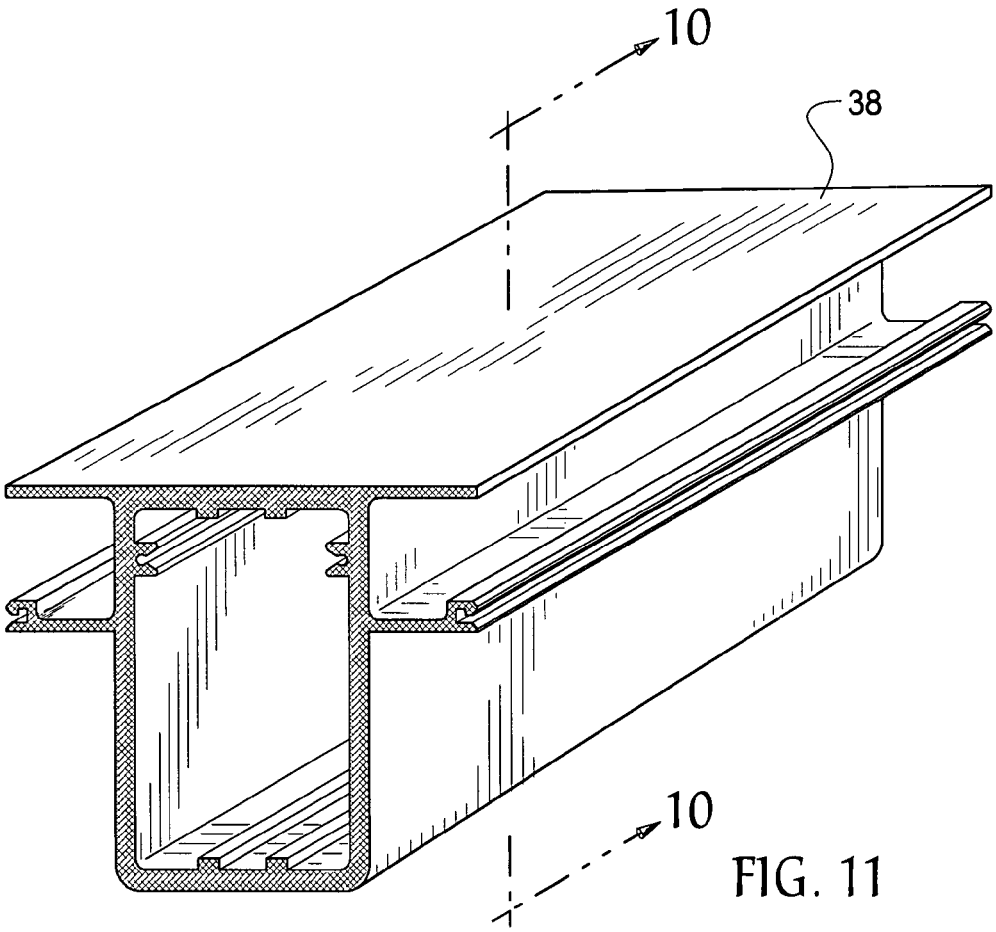
FIG. 11 is a perspective view of the movable panel assembly mullion.
Figure 12:
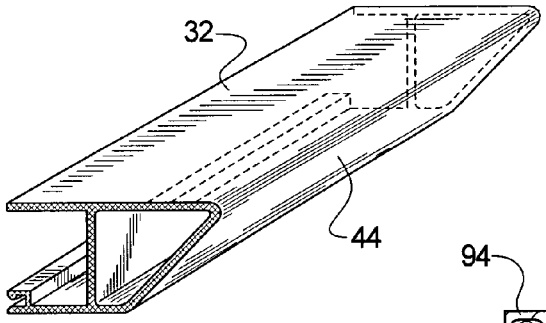
FIG. 12 is a perspective view of the door side extrusion.
Figure 13:
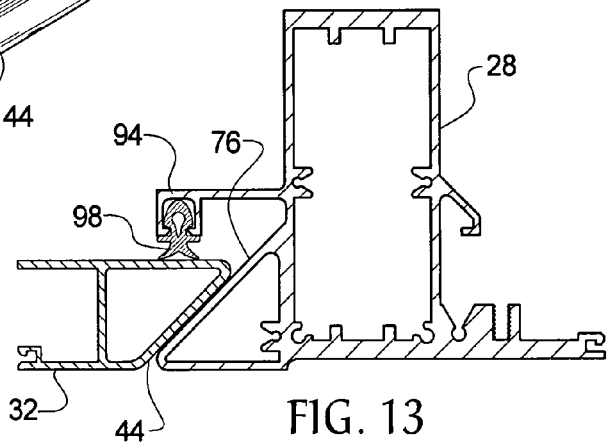
FIG. 13 is a section view taken along line 13-13 in FIG. 14.
Figure 14:
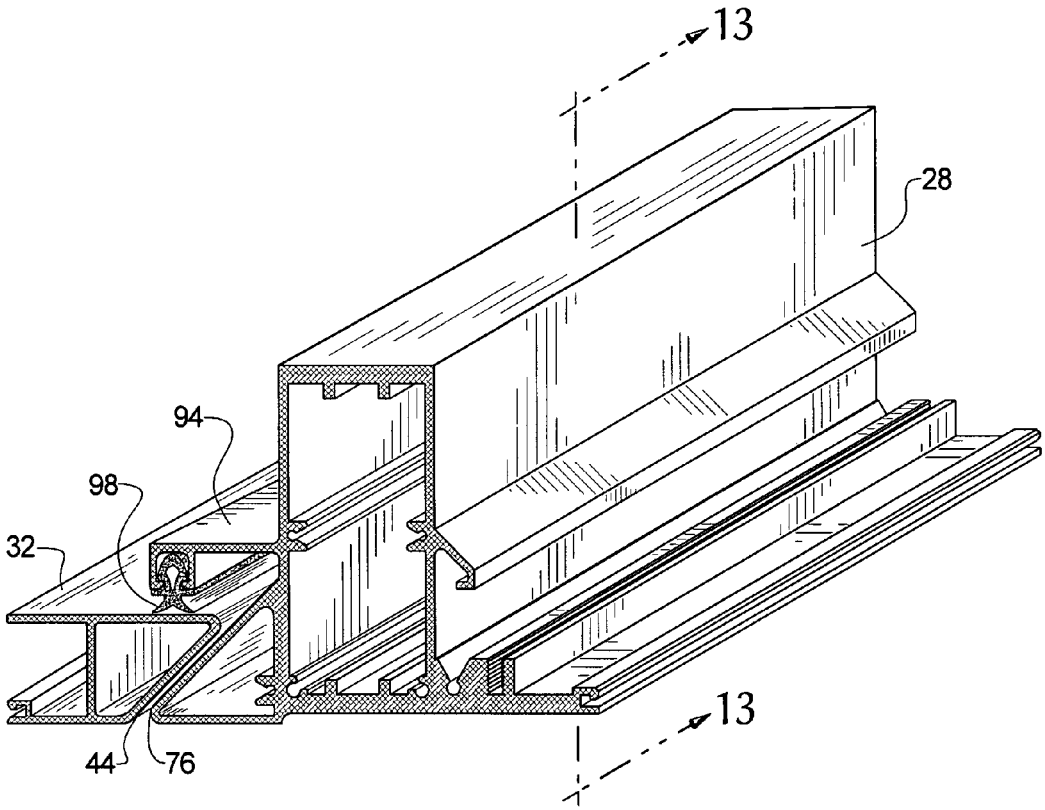
FIG. 14 is a perspective view of the move-fix mullion and the door side extrusion in a mated relationship when the movable panel is in the closed position.
Figure 15:
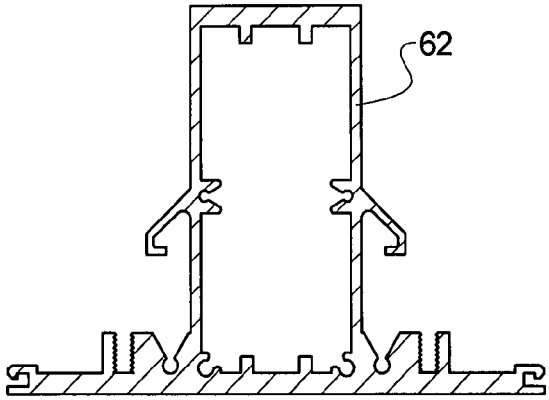
FIG. 15 is a section view taken along line 15-15 in FIG. 16.
Figure 16:
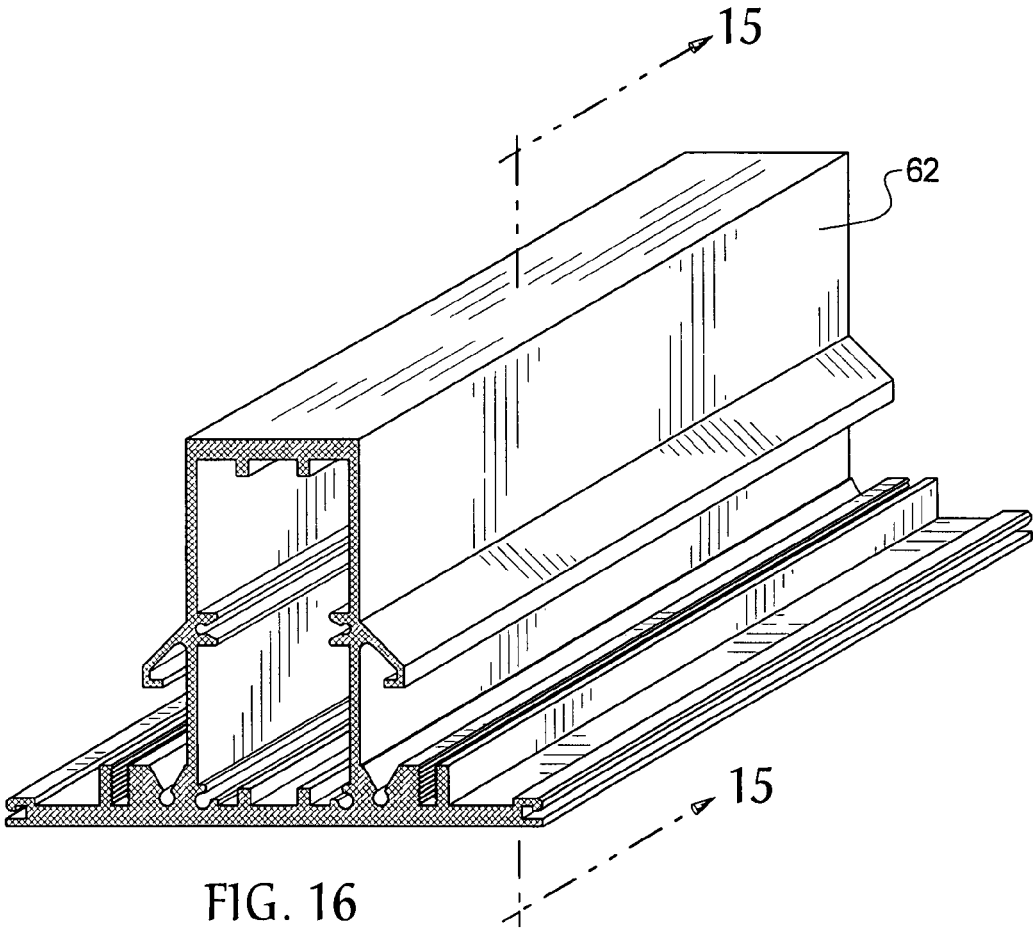
FIG. 16 is a perspective view of a mullion on a non-moving panel assembly.
Figure 17:
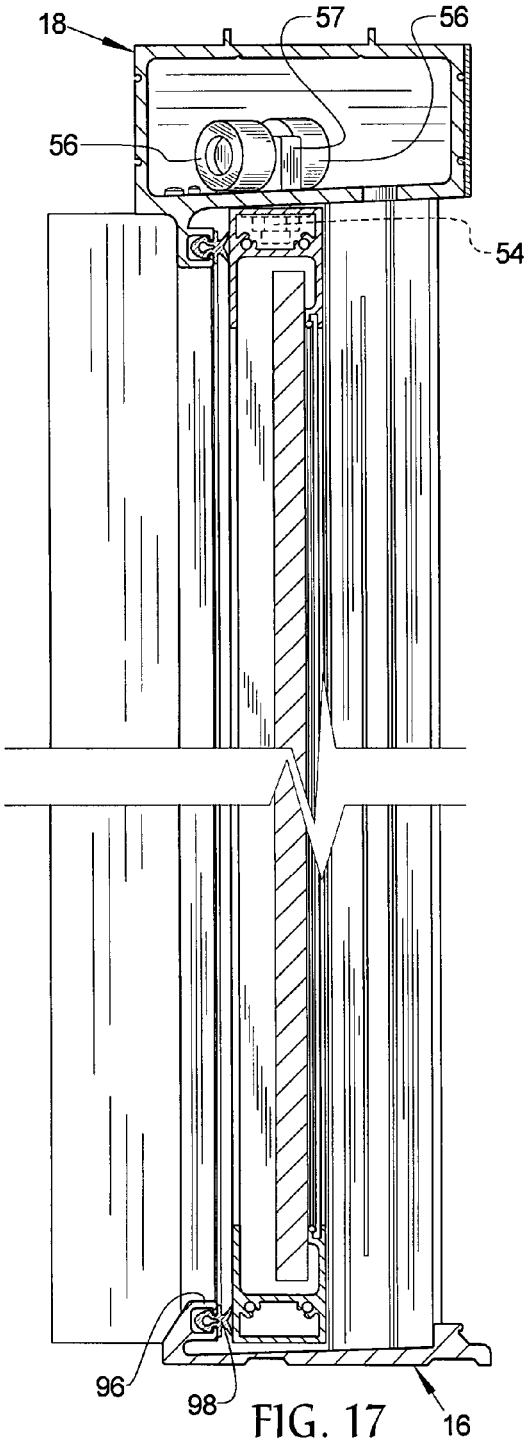
FIG. 17 is section view taken along line 17-17 in FIG. 1.
Figure 19:
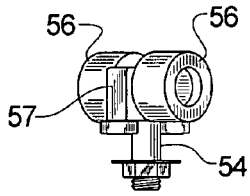
FIG. 19 is a perspective view of the roller assembly.
Figure 18:
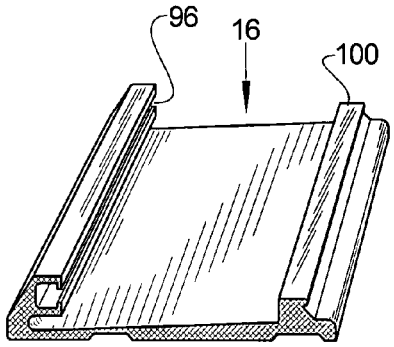
FIG. 18 is a perspective view of the floor threshold.
Figure 20:
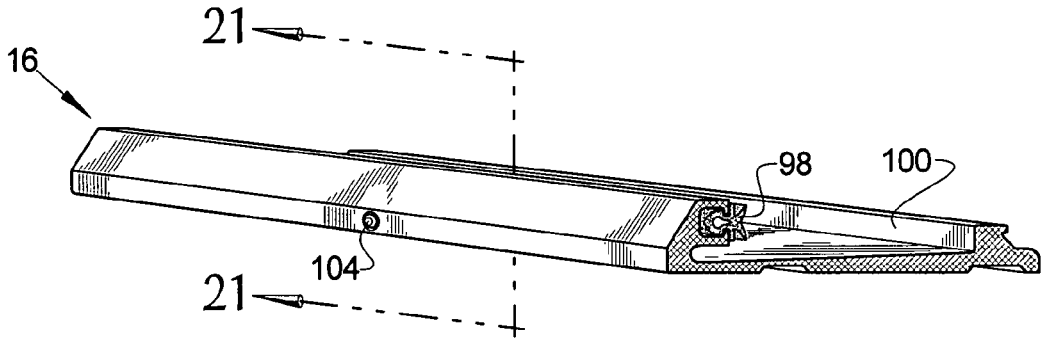
FIG. 20 is a perspective view of the threshold assembly with a drain valve centrally located thereat.
Figure 21:
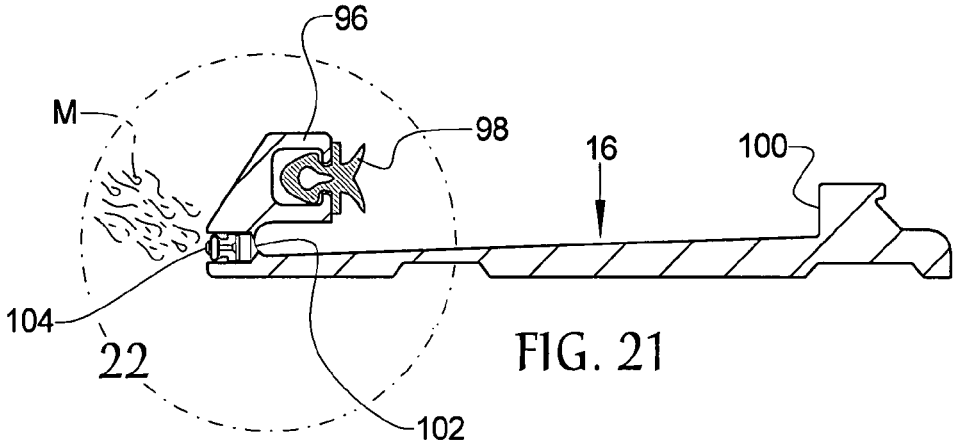
FIG. 21 is a section view of the threshold taken along line 21-21 in FIG. 20.
Figure 22:
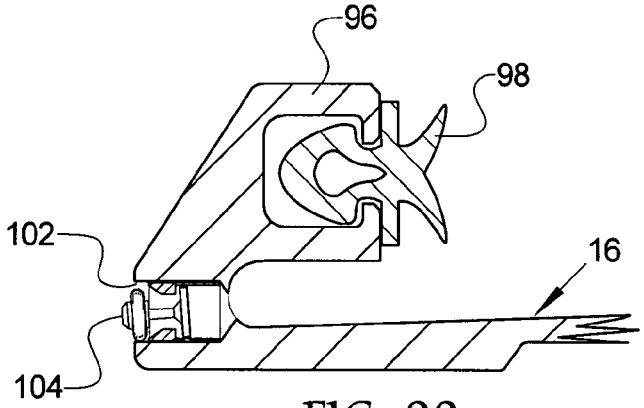
FIG. 22 is a detail view of the drain valve.

As best seen in FIGS. 5 and 6, the header assembly 18 has a hollow interior 78 and has a pair of channels 80 (only one illustrated) wherein each channel 80 has a straight section 82 and a curved section 84. The curved section 84 of one of the channels 80 is located proximate the move-fix mullion 28 of the non-overlay panel assembly 22 and the straight section 82 of the channel 80 extends from the curved section 84 to just prior to the fix-move mullion 26 of the overlay panel assembly 20, and the curved section 84 of the other channel 80 is located just beyond the end of the straight section 82 of the previous channel 80 and the straight section 82 of this second channel 80 extends from the curved section 84 of this channel 80 and terminates just prior to the jamb 14 of the overlay panel assembly 20. The posts 54 of the movable panel assembly 24 pass through the channels 80, one post 54 per channel 80 such that the rollers 56 ride along an inner surface of the base 86 of the header assembly 18. As seen, the base 86 of the header assembly 18 slopes downwardly in progressing from the straight section 82 to the curved section 84. Access ports 88 are located on the header assembly 18 in order to allow removal of the rollers 56 whenever the movable panel assembly 24 is in the closed position so as to be able to remove the movable panel assembly 24 from the remainder of the device 10 in order to service or otherwise replace the movable panel assembly 24. As seen, a channel 90 extends downwardly from the base 86 of the header assembly 18 which channel 90 mates with a channel 92 located on the fix-move mullion 26 and also mates with a channel 94 on the move-fix mullion 28. The channel 92 on the fix-move mullion 26 and the channel 94 on the move-fix mullion 28 each mate with a channel 96 that extends along the threshold 16. A sealing gasket 98, made from appropriate sealing material such as rubber or neoprene, is disposed within the channel 90 on the header assembly 18, the channel 92 on the fix-move mullion 26, the channel 94 on the move-fix mullion 28, and the channel 96 on the threshold 16. Advantageously, the gasket 98 is a single uninterrupted member, however, the gasket 98 can comprise individual units, one unit for each channel 90, 92, 94, and 96 or other appropriate sectioning of the gasket 98.

The sliding door assembly 10 is used by installing the frame assembly 12 to the building in the usual way. Each of the various components of the frame assembly 12 has appropriate mounting and sealing flanges, channels, gaskets, etc., for installation within the building which components are typical of such frame assembly components and are not individually described or numbered. Similarly, the various components of the frame assembly 12, including the various mullions, have appropriate seating and sealing flanges, channels gaskets, etc., to receive and secure the various glazing units as is typical of such components which are not individually described or numbered. Some of the various frame assembly 12 components may have internal honeycomb structures for added structural integrity of the components, which honeycomb features are typical of such components as is well known in the art. Once the frame assembly 12 is installed within the building, the movable panel assembly 24 works by sliding back and forth between an open position and a closed position. In the closed position, the movable panel assembly 24 is between the fix-move mullion 26 and the move-fix mullion 28 with the movable panel assembly 24 being generally flush with the overlay panel assembly 20 and the non-overlay panel assembly 22, if used. The first face angled face 42 of the door latch side 30 faces the third angled face 66 of the fix-move mullion 26. Similarly, the second angled face 44 of the door side 32 faces the fourth angled face 76 of the move-fix mullion 28. The posts 54 are located proximate the terminal end of the respective curved section 84 of their respective channels 80. The various frame components of the movable panel assembly 24, including the door latch side 30, the door side 32, the door top 34, and the door bottom 36 press against the gasket 98 located within the channel 90 of the header assembly, the channel 92 of the fix-move mullion 26, the channel 94 of the move-fix mullion 28, and the channel 96 of the threshold 16, respectively. The pressing of the movable panel assembly 24 against the gasket 98 provides the moisture barrier for the movable panel assembly 24. The press of the movable panel assembly 24 against the gasket 98 is sufficiently strong so as to prevent moisture from penetrating past the gasket 98 even if driven by wind or if the moisture is from a pressurized fluid source such as a hose. When the movable panel assembly 24 is in the closed position, the latches 48 of the latch assembly 46 are received within their respective keepers 50 such that the latches 48 draw the movable panel assembly 24 onto the gasket 98 that is held within the channels 90, 92, 94, and 96 of bearing components 18, 26, 28, and 16 respectively. In order to open the sliding door assembly 10, the latch assembly 46 is unlatched (the latch assembly 46 is unlocked if needed prior to unlatching) so that latches 48 are removed from their respective keepers 50. The movable panel assembly 24, which is now free to move, is pulled on so as to roll laterally and outwardly (posts 54 travel through the curved section 84 of their respective channel 80 during this lateral and outward travel of the movable panel assembly 24) and then, once the posts 54 enter the straight section 82 of their respective channels 80, the movable panel assembly 24 continues to roll laterally toward the jamb 14 proximate the overlay panel assembly 20. As the movable panel assembly 24 is being so moved, the posts 54 travel from the curved section 84 of their respective channel 80 and thereafter travel along the straight section 82 of their respective channel 80, the rotatable attachment of the posts 54 to the door top 34 to the movable panel assembly 24 allow the rollers 56 to be able to change direction with the direction change of the channel 80. The rollers 56 roll along the inner surface of the base 86 of the header assembly 18. The rollers 56 bear the weight of the movable panel assembly 24. During lateral and outward movement of the movable panel assembly 24 (just after unlatching and the beginning of the movable panel assembly 24 opening process) the posts 54 travel along the curved section 84 of their respective channel 80. Once the movable panel assembly 24 is moving just laterally, the posts 54 travel along the straight section 82 of their respective channel 80. The movable panel assembly 24 is placed into any desired location. In order to place the movable panel assembly 24 into the closed position, the movable panel assembly 24 is slid back toward the move-fix mullion 28. The movable panel assembly 24 travels just laterally until just before being closed, such that posts 54 travel within the straight section 84 of their respective channel 80. Just as the movable panel assembly 24 is about to close, the posts 54 encounter the curved section 84 of their respective channel 80, causing the movable panel assembly 24 to travel inwardly and downwardly laterally toward being generally flush with the overlay panel assembly 20 and thus closed. The sloped nature of the base 86 helps the movable panel assembly 24 roll toward the closed position. Once the movable panel assembly 24 again presses against the gasket 98, the movable panel assembly 24 is in the closed position, and the latch bar 52 of the latch assembly 46 is thrown in order to engage the latches 48 into their respective keepers 50 in order to draw the movable panel assembly 24 into pressing engagement with the gasket 98 and the components holding the gasket 16, 18, 26, and 28 and thereby hold the movable panel assembly 24 in the closed position. The movable panel assembly 24 is locked if desired. Upwardly extending lips 100 located on the threshold 16 help keep bottom of the movable panel assembly 24 properly aligned and help prevent the bottom of the movable panel assembly from popping out during travel. As seen, the threshold 16 is sloped similarly to the slope of the base 86 of the header assembly 18. This slope allows for freedom of travel of the movable panel assembly 24 and for directing accumulated moisture out of the device 10 through appropriate weep holes 102. As the first angled face 42 and the third angled face 66 are angled and face one another and similarly, the second angled face 44 and the fourth angled face 76 are also face one another, the respective angle face pairs 42-66 and 44-76 slide past one another just as the movable panel assembly 24 is opening or closing. The respective angle face pairs 42-66 and 44-76 are also close to one another whenever the movable panel assembly 24 is in the closed position in order to help prevent moisture penetration. The angled facing face pairs 44-76, coupled with the latches 48 on the door latch side 30 of the movable panel assembly 24 being firmly latched within their respective keepers 50 on the fix-move mullion 26, hold the movable panel assembly 24 firmly in place, whenever the movable panel assembly 24 is in the closed position even when the device 10 is subject to strong pressure loading as may be occasioned during a tropical weather system.

In order to discharge any moisture M that penetrates past the sliding door assembly 10, such as if the door is not fully closed during a storm, accumulates at the threshold 16, which is sloped downwardly toward the exterior of the building into which the sliding door assembly 10 is installed. One or more weep holes 102 are located at the lower side edge of the threshold 16 in order to allow the accumulated moisture M to be discharged out of the building to the outside. A valve 104, which is a specially designed one-way valve similar in construction to a medical valve that are often found on medical instruments such as catheters and used to prevent backflow in such devices, is press fit into each weep hole 102. The valve 104, which may or not be spring-loaded is a one-way valve that allows water or other liquids to pass from the sill 16 to the outside while preventing the liquid from backing back up into the sill.

While the invention has been particularly shown and described with reference to an embodiment thereof, it will be appreciated by those skilled in the art that various changes in form and detail may be made without departing from the spirit and scope of the invention.

We claim:

1. A sliding door assembly comprising:

a frame having a header and a threshold joined by a first mullion and a second mullion, the header having a first channel with a curved section and a straight section;

a compression gasket attached to the header, the threshold within a second channel running along a length of the threshold, the first mullion, and the second mullion;

a sash, having a first jamb and a second jamb each joined by a top leg and a bottom leg;

a post pivotally attached to the top of the sash and protruding through the channel with a roller attached to the end of the post, the roller capable of traveling along the header;

a keeper located on the first mullion;

an upwardly extending lip located on the threshold opposite to and generally parallel with the second channel;

a latch attached to the side jamb of the sash; and wherein the sash is slidable between an open position and a closed position wherein when the sash is in a closed position the latch is received within the keeper in order to place the sash into pressing engagement with the gasket in order to create a seal between the sash and the frame, and the post is within the curved section of the first channel, and when the sash slides to the open position, the post travels from the curved section to the straight section, and such that bottom of the sash is always at least partially within the passageway and is capable of laterally moving between the gasket and the lip without a constraint placed upon the bottom leg of the sash such that the lip guides the bottom leg of the sash whenever the sash to traveling between the closed position and the open position.

2. The assembly as in claim 1 wherein the header tilts downwardly in proceeding from the straight section of the first channel to the curved section of the first channel in order to gravitationally assist the sash in sliding to the closed position.

3. The assembly as in claim 1 wherein the gasket is located within the second channel as well as within a third channel that extends along a portion of the header, the first mullion, and the second mullion.

4. The assembly as in claim 1 wherein the gasket is a unitary member.

5. The assembly as in claim 1 wherein the threshold is laterally sloped and has a weep hole at a lower end, the weep hole having a one-way valve therein.

6. A sliding door assembly comprising:

a frame having a header and a threshold joined by a first mullion with a first angled face and a second mullion with a second angled face, the header having a first channel with a curved section and a straight section;

a compression gasket attached to the header, within a second channel running along a length of the threshold, the first mullion, and the second mullion;

a sash, having a first jamb with a third angled face and a second jamb with a fourth angled face the first jamb and the second jamb joined by a top leg and a bottom leg;

a post pivotally attached to the top of the sash and protruding through the channel with a roller attached to the end of the post, the roller capable of traveling along the header;

a keeper located on the first mullion;

an upwardly extending lip located on the threshold opposite to and generally parallel with the second channel so as to define a passageway therebetween;

a latch attached to the side jamb of the sash; and wherein the sash is slidable between an open position and a closed position wherein when the sash is in a closed position the latch is received within the keeper in order to place the sash into pressing engagement with the gasket in order to create a seal between the sash and the frame, and the post is within the curved section of the channel, and when the sash slides to the open position, the post travels from the curved section to the straight section and wherein that the first angled face fares the third angled face and the second angled face faces the fourth angled face whenever the sash is in the closed position, and such that bottom of the sash is always at least partially within the passageway and is capable of laterally moving between the gasket and the lip without a constraint laced upon the bottom leg of the sash such that the lip guides the bottom leg of the sash whenever the sash to traveling between the closed position and the open position.

7. The assembly as in claim 6 wherein the header tilts downwardly in proceeding from the straight section of the first channel to the curved section of the first channel in order to gravitationally assist the sash in sliding to the closed position.

8. The assembly as in claim 7 wherein the gasket is located within the second channel as well as within a third channel that extends along a portion of the header, the first mullion, and the second mullion.

9. The assembly as in claim 6 wherein the gasket is located within the second channel as well as within a third channel that extends along a portion of the header, the first mullion, and the second mullion.

10. The assembly as in claim 6 wherein the threshold is laterally sloped and has a weep hole at a lower end, the weep hole having a one-way valve therein.

11. A sliding door assembly comprising:

a frame having a header that has a base, the header also having a threshold joined by a first mullion and a second mullion, the header having a first channel with a straight section and a curved section with a proximal end at the straight section and a distal end such that the header is downwardly sloped in the a direction that is transverse to a longitudinal axis of the straight section of the first channel and downwardly toward the distal end of the curved section of the first channel;

a compression gasket attached to the header, the threshold, the first mullion, and the second mullion;

a sash, having a first jamb and a second jamb each joined by a top leg and a bottom leg;

an upwardly extending lip located on the threshold opposite to and generally parallel with the second channel so as to define a passageway therebetween;

a post pivotally attached to the top of the sash and protruding through the channel with a roller attached to the end of the post, the roller capable of traveling along the base of the header;

a keeper located on the first mullion;

a latch attached to the side jamb of the sash; and wherein the sash is slidable between an open position and a closed position wherein when the sash is in a closed position the latch is received within the keeper in order to place the sash into pressing engagement with the gasket in order to create a seal between the sash and the frame, and the post is within the curved section of the first channel, and when the sash slides to the open position, the post travels from the curved section to the straight section and such that the sloped nature of the base gravitationally assists the sash in sliding to the closed position only when the post travels in the curved section, and such that bottom of the sash is always at least partially within the passageway and is capable of laterally moving between the gasket and the lip without a constraint placed upon the bottom leg such that the lip guides the bottom leg of the sash whenever the sash to traveling between the closed position and the open position.

12. The assembly as in claim 11 wherein the gasket is located within a second channel that extends along a portion of the header, the first mullion, and the second mullion and within a third channel that extends along the threshold.

13. The assembly as in claim 12 wherein the threshold has an upwardly extending lip that runs generally parallel with the third channel in order to guide the sash between the closed position and the open position.

14. The assembly as in claim 11 wherein the gasket is a unitary member.

* * * * *